US005492401A

United States Patent [19]

Halsted

[11] Patent Number: 5,492,401

[45] Date of Patent: Feb. 20, 1996

[54] CONCRETE MIXER WITH PLASTIC DRUM

[76] Inventor: David W. Halsted, 7438 Pleasant St., Hemlock, N.Y. 14466

[21] Appl. No.: 280,458

[22] Filed: Jul. 26, 1994

[51] Int. Cl.[6] ..... B28C 5/18

[52] U.S. Cl. ..... 366/47; 366/185

[58] Field of Search ..... 366/44, 45, 46, 366/47, 48, 54, 57, 56, 219, 220, 228, 229, 185, 189

[56] References Cited

U.S. PATENT DOCUMENTS

| | | | |
|---|---|---|---|
| Re. 34,505 | 1/1994 | Whiteman, Jr. | 366/46 |
| 2,494,119 | 1/1950 | Essick | 366/45 |
| 3,473,789 | 10/1969 | Dietrich | 259/175 |
| 3,768,785 | 10/1973 | Susemihl | 366/47 |
| 4,435,082 | 3/1984 | Bishop | 366/47 |
| 4,491,415 | 1/1985 | Bishop | 366/47 |
| 4,521,116 | 6/1985 | Adsit | 366/45 |
| 4,569,648 | 2/1986 | Riederer et al. | 425/222 |
| 4,750,840 | 1/1988 | Bishop | 366/54 |
| 4,756,623 | 7/1988 | Bishop | 366/57 |
| 4,877,327 | 10/1989 | Whiteman, Jr. | 366/46 |
| 5,118,198 | 6/1992 | Whiteman, Jr. | 366/47 |

*Primary Examiner*—Robert W. Jenkins
*Attorney, Agent, or Firm*—Jacobson, Price, Holman & Stern

[57] ABSTRACT

A concrete mixer having a mixing drum constructed of high density crosslink polyethylene material. The drum includes a bottom supported by a conventional rigid metal pan secured to the external surface thereof to rigidify the plastic drum and extend the life expectancy of the plastic drum by enabling the concrete mixer to be used to complete a mixing job at a job site even though movement of the concrete mix within the drum during repetitive mixing cycles may ultimately wear a hole through the bottom of the plastic drum. Paddle assemblies are positioned interiorly of the drum and oriented to maintain minimum splashing during the mixing operation. A rigid ring gear is attached peripherally of the drum in spaced relation to the metal supporting pan with the drum, ring gear and metal bottom pan being uniquely related to facilitate assembly and disassembly of the components to facilitate easy replacement of the components.

26 Claims, 3 Drawing Sheets

CONCRETE MIXER WITH PLASTIC DRUM

BACKGROUND OF THE INVENTION

1. Field of the Invention

The present invention generally relates to a powered, mobile concrete mixer having a mixing drum constructed of high density crosslink polyethylene plastic material. The drum includes a bottom supported by a conventional rigid metal pan secured to the external surface thereof to rigidify the plastic drum and extend the life expectancy of the mixer. A paddle assembly is positioned interiorly of the drum and is oriented to obtain minimum splashing during the mixing operation. A rigid metal ring gear is attached peripherally of the drum in spaced relation to the metal supporting pan with the ring gear and metal bottom pan being uniquely related to facilitate assembly and disassembly of the components for easy replacement of the components.

2. Description of the Prior Art

Concrete mixers of the type utilizing a generally vertically or angularly disposed mixing drum driven about a longitudinal axis with a paddle assembly mounted interiorly of the drum are well known. The drum includes a rigid peripheral ring gear mounted peripherally of the drum above the closed bottom end and below an open top end for rotating the drum about a generally longitudinal axis. The drum is supported from a frame by a yoke pivotally supported from the frame and a cradle assembly to enable pivotal movement of the drum from a generally vertical position to a tilted position with the open end of the drum being disposed below the pivotal axis of the drum to dump mixed concrete from the drum. A manually operated wheel or handle structure is associated with the yoke and frame to manually pivot the drum between a mixing position and a dumping position.

Concrete mixers as described above in which the drum is constructed of metal have been used for many years. In view of developments in plastic materials, recent efforts have been made to utilize a mixing drum constructed of plastic material in lieu of a metal mixing drum. High density crosslinkable polyethylene or suitable equivalent plastic material has been used rather than heavy steel and certain advantages are derived from the use of the plastic material, such as, reduction in weight, easier and more effective cleaning of the drum and substantial reduction in labor intensive removal of hardened concrete which, when bonded to the interior of a steel mixing drum, requires extensive effort and time to remove.

The following U.S. patents relate to the construction of concrete mixers of the type in which the mixing drum rotates about a generally vertical or inclined longitudinal axis during the mixing operation and is tiltable or pivotal to a dumping position or disclose mixing drums constructed of plastic material:

U.S. Pat. No. 3,473,789
U.S. Pat. No. 4,435,082
U.S. Pat. No. 4,491,415
U.S. Pat. No. 4,569,648
U.S. Pat. No. 4,750,840
U.S. Pat. No. 4,756,623
U.S. Pat. No. 4,877,327
U.S. Pat. No. Re: 34,505
U.S. Pat. No. 5,118,198

U.S. Pat. No. 5,118,198 and the prior art listed and discussed therein, which is incorporated herein by reference thereto, discloses a cement mixer having a polyethylene mixing drum supported by a rigid cradle including radial support bars or braces under the bottom of the drum and four upright cradle arms that are attached to the polyethylene drum and a ring gear or bull gear by bolts extending through the gear, upper ends of the arms and the peripheral wall of the polyethylene mixing drum. The cradle is rotatably supported by a pivotal yoke supported from a frame. However, the prior patents listed above do not disclose concrete mixers which offers the same advantages in construction and design as achieved by the mixer of the present invention.

SUMMARY OF THE INVENTION

A primary object of the present invention is to provide a concrete mixer power driven about substantially a vertical or inclined axis when in mixing position in which the drum is constructed of a substantially rigid plastic material. The bottom end of the plastic drum is reinforced and supported by a metal pan or dish which rigidifies the plastic drum and enables continued use of the concrete mixer even though a hole may be worn in the bottom portion of the plastic drum.

Another object of the invention is to provide a concrete mixer in accordance with the preceding object in which the plastic drum includes paddle assemblies mounted interiorly thereof oriented in angular position and constructed to mix concrete with minimum splashing of the concrete mix.

A further object of the invention is to provide a concrete mixer having a mixing drum of plastic material in which a peripheral, rigid ring gear attached peripherally of a cylindrical portion of the drum is vertically spaced above and separate from the metal bottom reinforcing pan so that the drum can be secured to the ring gear at multiple spaced peripheral locations to pull the periphery of the plastic drum into surface to surface contact with the interior of the ring gear to reinforce and rigidify the upper periphery of the drum and form the periphery of the drum into cylindrical configuration by contact with the ring gear.

Still another object of the invention is to provide a concrete mixer in accordance with the preceding object in which the plastic drum is constructed of high density, crosslinkable polyethylene or equivalent plastic material with the periphery of the drum including a plurality of longitudinally extending, generally channel shaped recesses to rigidify and shape the periphery of the drum.

A still further object of the invention is to provide a concrete mixer in accordance with the preceding object in which the lower ends of the channel shaped recesses define a thickened shoulder area to enable bolts or similar fastening means to be utilized to secure the periphery of the metal pan to the bottom of the mixing drum.

Yet another object of the invention is to provide a concrete mixer in accordance with the preceding objects in which the paddle assembly interiorly of the drum includes alternately position paddles at different angles and of different structural characteristics to reduce splashing of the concrete mix.

Another significant object of the invention is to provide a concrete mixer in accordance with the preceding objects which includes a rigid, wheeled frame which can be effectively towed behind a towing vehicle with the plastic drum enabling easy and quick cleaning and which also resists dents, chips, rust and fading with the high density crosslinkable polyethylene providing a rugged and long life expectancy to the mixer.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
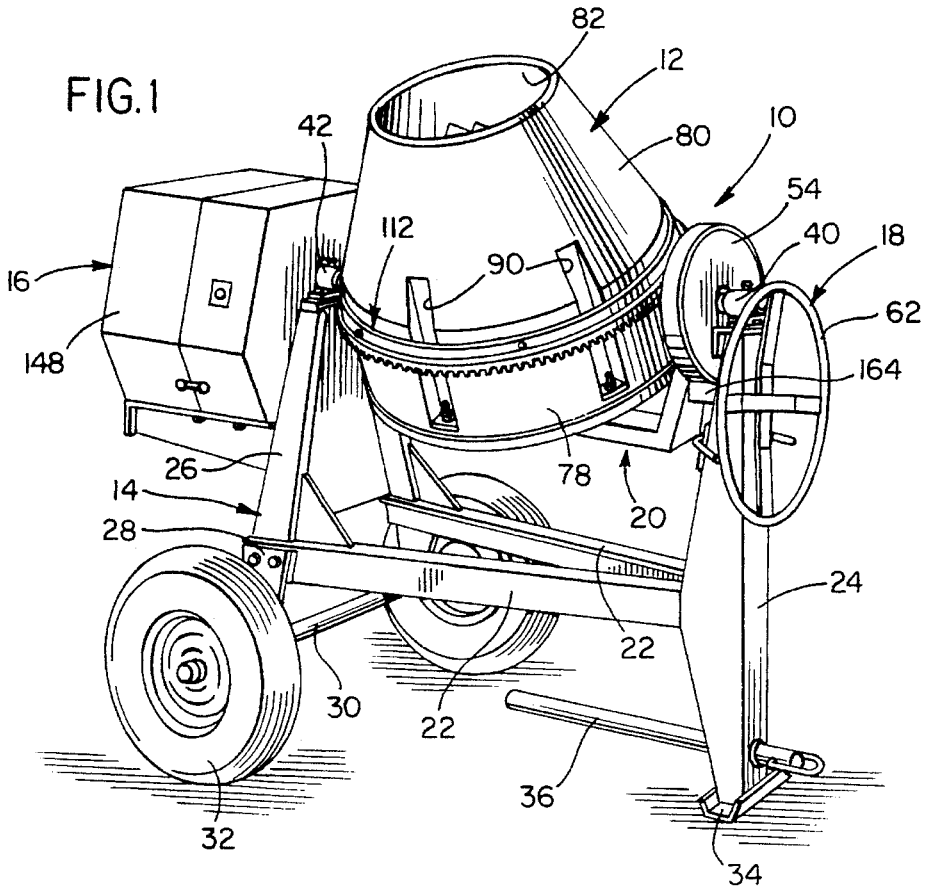
FIG. 1 is a perspective view of the preferred concrete mixer in accordance with the concepts of the present invention.
Figure 2:
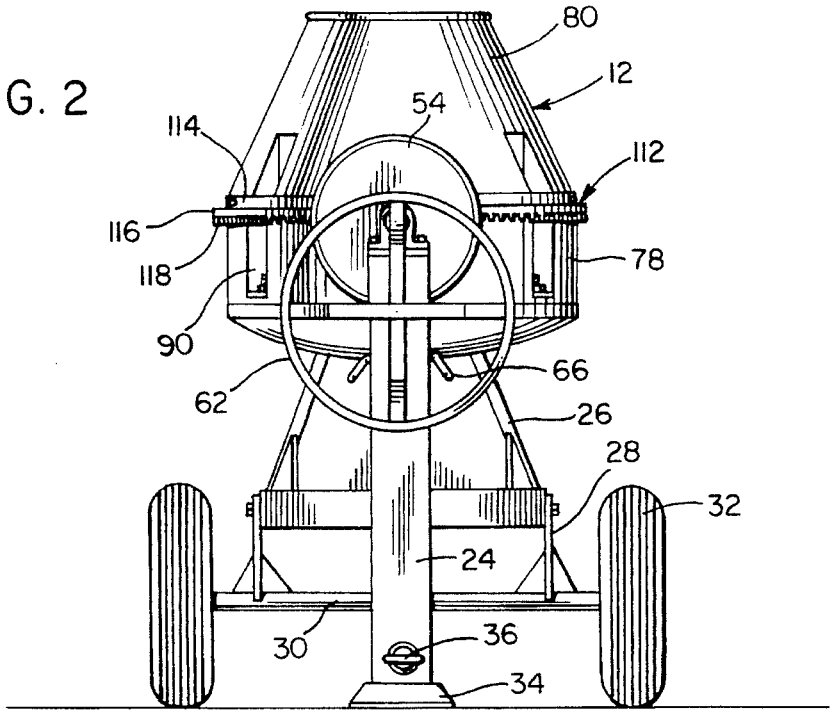
FIG. 2 is an end elevational view of the concrete mixer shown in FIG. 1.

The concrete mixer of this invention is generally designated by reference numeral 10 and includes a mixing drum 12 constructed unitarily of crosslinked polyethylene or equivalent plastic material. The mixer includes a rigid frame structure generally designated by reference numeral 14, a power unit 16 for rotating the drum 12 about a generally vertical or inclined position axis when in its mixing position and a manually operated hand wheel 18 for pivoting or tilting the drum 12 through a pivotally supported yoke 20.

The frame 14 includes longitudinally extending frame members 22 having one end connected to a vertical supporting standard 24 and diverging toward the other end and connected to upwardly converging standards 26. The juncture between the diverging frame members 22 and the upwardly converging standards 26 are provided with depending support plates 28 supporting an axle 30 with the axle 30 including ground engaging pneumatic wheel and tire assemblies 32 to enable the device to be towed behind a towing vehicle. The front standard 24 is provided with a bottom shoe 34 and a hitch assembly 36 adjacent the shoe by which the concrete mixer can be connected to a towing vehicle.

Figure 3:
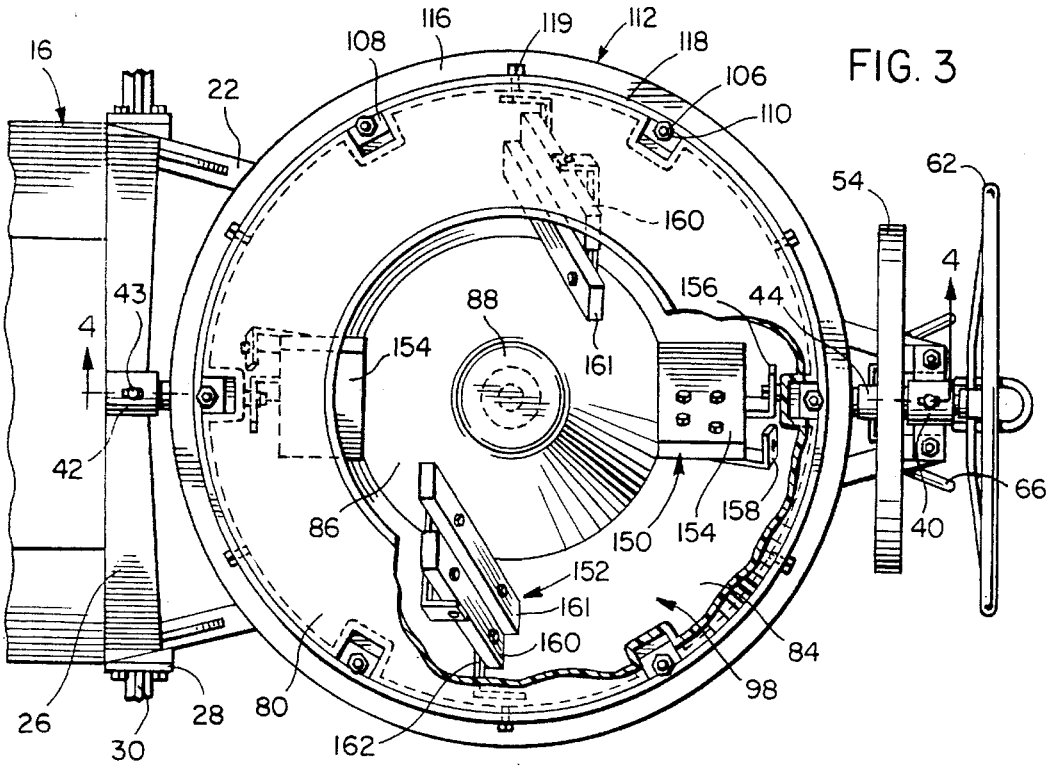
FIG. 3 is a top plan view of the concrete mixer of FIG. 1 with a portion of the mixer drum broken away to illustrate the paddle assembly structure.

The upper end of the standard 24 is provided with a tubular bearing sleeve 40 rigid therewith and the upper apex end of the standards 26 are also provided with a bearing sleeve 42. The bearing sleeves 40 and 42 are provided with capped lubrication fittings 43 and are generally cylindrical in construction and are oriented in aligned relation to each other as illustrated in FIG. 3. The bearing sleeves 40 and 42 rotatably support tubular support shafts 44 and 46 which are received in the bearing sleeves 40 and 42 and extend inwardly therefrom. The inner ends of the tubular shafts 44 and 46 are rigidly connected to upwardly diverging legs 48 of the yoke 20 which includes a generally horizontally disposed member 50. The horizontally disposed member 50 and the upwardly diverging legs 48 are rigid in relation to each other and are rigidly connected to the tubular shaft 44 and 46 with the bearing sleeves 40 and 42 supporting the yoke 20 for pivotal movement about an axis defined by the center of the bearing sleeves 40 and 42.

Rigidly mounted on the tubular shaft 44 is a gear 52 having a protective guard 54 associated therewith and a lower peripheral portion of the gear 54 is in meshing engagement with a small pinon gear 56 mounted on a shaft 58 extending thorough a sleeve bearing 60 on the standard 24 with the outer end of the shaft 58 being connected to hand wheel 18 which includes a circular member 62 that can be manually rotated to rotate the gears 56 and 52 thus pivoting or tilting the yoke 20 about the transverse generally horizontal axis defined by the tubular shafts 44 and 46.

Figure 6:
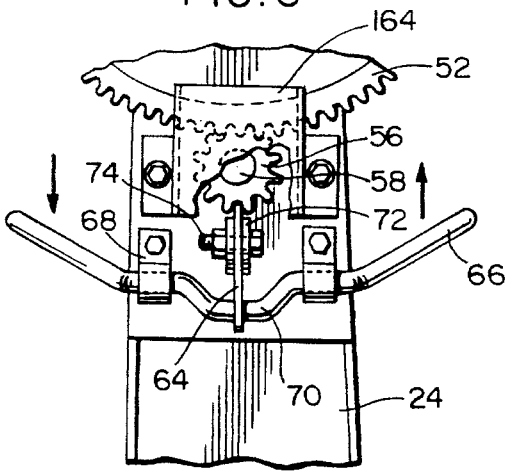
FIG. 6 is a fragmental elevational view illustrating the positive drum lock to prevent tilting or pivotal movement of the mixing drum when the mixing drum is being rotated in a mixing position.

A lock structure for the gear 56 is illustrated in FIG. 6 and includes a lock plate 64 moving into engagement with the teeth on the gear 56 in response to pivotal movement of a handle 66 mounted pivotally on the standard 24 by brackets 68 and including an offset portion 70 to move the locking plate 64 toward and away from the gear 56. The locking plate 64 is supported by brackets 72 mounted on the standard 24 and a bolt 74 extending through the brackets 72 and a slot 76 in the locking plate 64 thus enabling movement of the locking plate 64 toward and away from the gear 56 in response to pivotal movement of the handle 66 thus locking the yoke 20 and the mixing drum 12 supported therefrom in an upright, generally vertical or inclined position during mixing of the cement mix within the drum in a manner described hereinafter.

Figure 4:
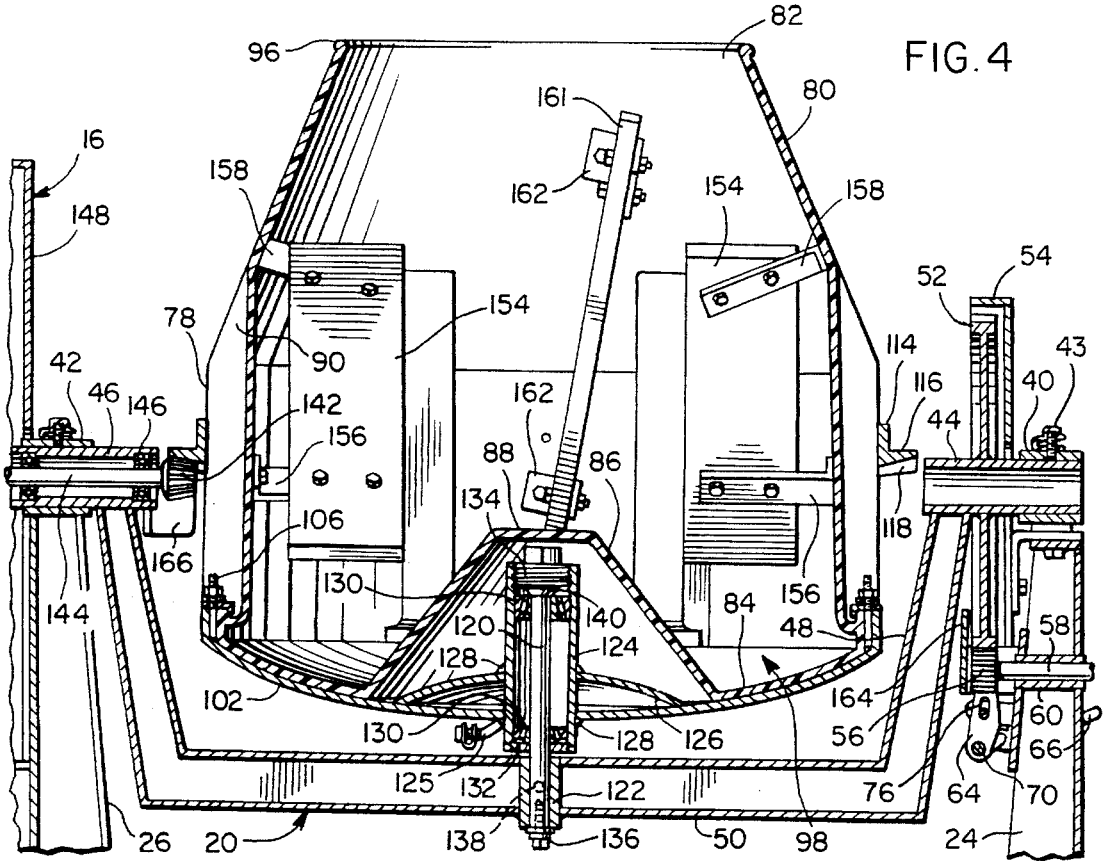
FIG. 4 is a vertical sectional view of the mixer taken substantially along a plane passing along section line 4—4 on FIG. 3 illustrating the specific structural details of the preferred concrete mixer.
Figure 5:
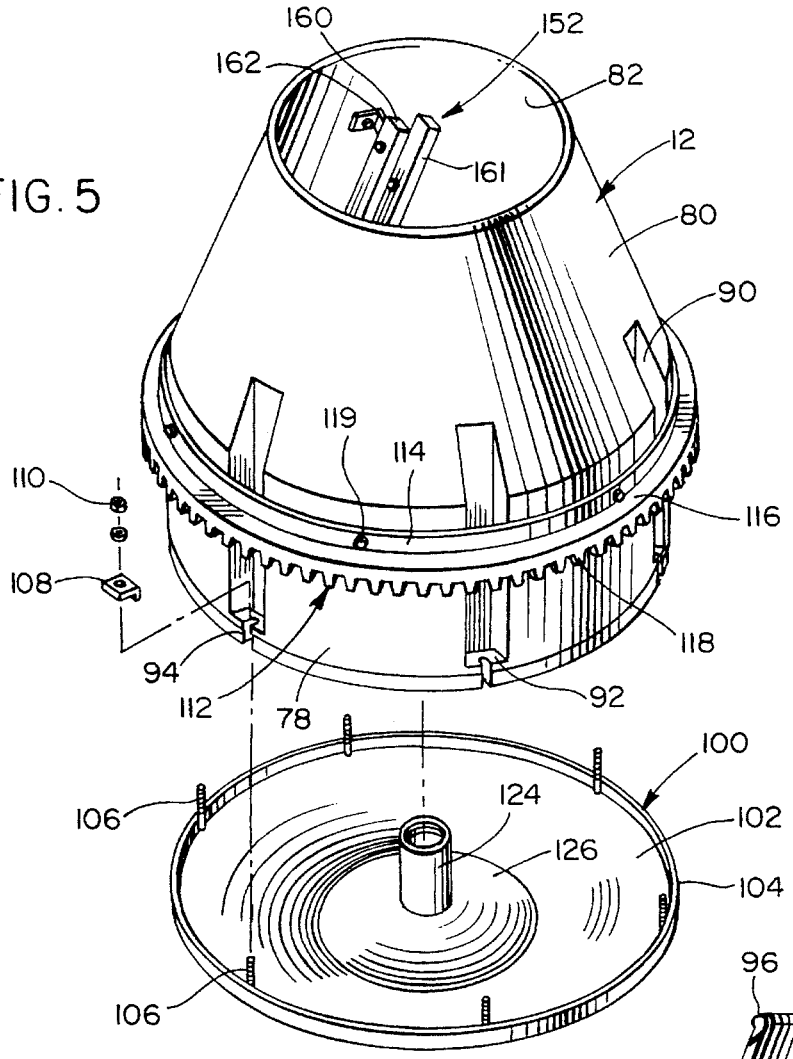
FIG. 5 is an exploded group perspective view of the plastic mixing drum, the ring gear mounted thereon and the metal bottom pan oriented in disassembled relation to the drum.

The mixing drum 12 is preferably constructed of substantially rigid high density, crosslinked polyethylene and includes a cylindrical lower end portion 78 and an upper tapering portion 80 which terminates in an open upper end 82. The lower end of the cylindrical portion 78 of the mixing drum 12 is provided with a unitary bottom 84 which includes a generally convexly curved external surface and a concavely curved internal surface as illustrated in FIG. 4. Centrally located and integrally molded in the bottom 84 is an upwardly extending conical portion 86 terminating in a generally flat upper end 88 as illustrated in FIG. 4. The periphery of the mixing drum 12 includes six inwardly offset, longitudinally oriented, channel shaped recesses 90 which extend upwardly from just above a juncture of the bottom 84 with the lower cylindrical portion 78 of the mixing drum 12 to just above the juncture between the cylindrical portion 78 and the tapered portion 80 of the drum 12 as illustrated in the drawings. As illustrated in FIG. 5, the bottom ends of the channel shaped recesses 90 are spaced slightly above the bottom 84 and define a generally horizontal shoulder 92 having a notch 94 extending inwardly in the shoulder and the portion of the cylindrical portion of the drum and the bottom 84. The mixing drum is of one piece construction and the open end 82 may preferably have a rib 96 formed thereon for rigidifying the open end of the drum. The upwardly extending member 86 in the bottom 84 of the drum preferably defines a peripheral trough area 98 (see FIG. 4) in cooperation with the inner periphery of the drum.

The mixing drum 12 is reinforced by a metal bottom pan generally designated by reference numeral 100 which includes a bottom member 102 having a convex bottom surface and a concave top surface conforming with and engaging the external surface of the bottom 84 of the mixing drum 12 as shown in FIG. 4. The periphery of the bottom member 102 includes an upstanding flange 104 which telescopes around the periphery of the lower end of the cylindrical portion 78 of the drum 12. The pan 100 may be sealed to the bottom 84 of the drum by the use of a bead of silicone sealant on bottom member 102 adjacent the flange 104 to prevent entry of foreign material.

Welded to the bottom pan 102 and the inner surface of the flange 104 are a plurality of threaded bolts 106 which are received in the notches 94 in the shoulders 92 on the drum when the pan 100 is assembled onto the bottom of the mixing drum 12. Mounted on each of the bolts 106 is a small plate 108 with a downturned inner edge, a washer and a retaining nut 110 which are assembled onto the bolt 106 to securely and rigidly lock the pan 100 and mixing drum 12 in assembled relationship with the pan rigidifying and supporting the bottom of the mixing drum and enabling continued use of the mixer even if a hole becomes worn in the bottom 84 of the drum after extensive use of the mixer.

Figure 7:
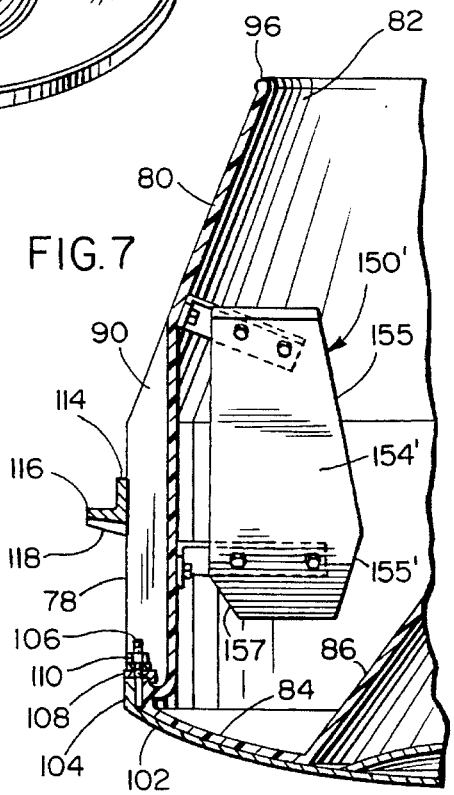
FIG. 7 is a fragmental sectional view illustrating another embodiment of a mixing paddle supported interiorly of the plastic mixing drum.

The mixing drum 12 is provided with a ring gear or bull gear 112 extending peripherally of the cylindrical lower portion 78 of the mixing drum 12 in vertically spaced relation above the pan flange 104 and below the junction between the cylindrical portion 78 and the tapered or frustroconical portion 80 of the mixing drum. The ring gear 112 is of unitary, rigid, cast metal construction and includes an inner vertical flange 114 of cylindrical configuration and an outwardly extending horizontal flange 116 having a plurality of downwardly facing gear teeth 118 thereon which incline outwardly and upwardly at a small angle as illustrated in FIGS. 4 and 7. The flange 114 of the ring gear 12 and the cylindrical lower portion 78 of the mixing drum 12 are secured together by a plurality of fastening bolts 119 which are oriented generally centrally located between the channel shaped recesses 90.

The mixing drum and pan are supported for rotational movement about a longitudinal axis centrally located with respect to the bottom 84 of the mixing drum 12 as illustrated in FIG. 4 with this supporting function being accomplished by a shaft 120 extending through a sleeve 122 rigidly affixed to the member 50 of the yoke 20. The shaft 120 also extends longitudinally into a cylindrical sleeve 124 rigidly affixed to the bottom member 102 of metal pan 100 with the sleeve 124 being reinforced and rigidified by a curved plate 126 secured to the upper surface of the bottom member 102 and secured to the periphery of the sleeve 124 above its intersection with the pan. The sleeve 124, bottom member 102 and the reinforcing plate 126 are rigidly affixed together, as by welding 128, thus providing a rigid tubular sleeve 124 centrally located in the pan and extending upwardly from a point slightly below the pan to a point adjacent but spaced downwardly from the upwardly offset member 88, as illustrated in FIG. 4.

The shaft 120 and the sleeve 124 are rotatably interconnected by a pair of spaced thrust bearings 130 with seals such as tapered roller bearings. The lower end of the sleeve 124 is closed by a retaining member 132 threaded into the lower end of the sleeve 124, and the upper end of the sleeve is closed by a threaded plug 134 threaded into the interior of the upper end of the sleeve 124 which also includes a lubrication fitting 125. The shaft 120 includes a fastener bolt 136 at the lower end thereof which is threaded into the end of the shaft and includes a thrust washer engaging the bottom end of the sleeve 122 rigid with yoke member 50. A lock screw 138 prevents vertical movement of the stationary shaft 120 in relation to the yoke member 50 with this structure also enabling removal of the shaft 120 in relation to the yoke member 50. The upper end of the shaft 120 is provided with an enlarged upper end 140 engaging the upper bearing assembly 130 thus maintaining the mixing drum and pan in a rotatably supported position on the yoke member 50 with the thrust bearings and the other components attached to the sleeve 124 preventing movement of the mixing drum and pan longitudinally of the shaft.

The mixing drum is rotatably driven by a bevelled gear 142 in meshing engagement with the gear teeth 118 on the ring gear 112, as illustrated in FIG. 4, with the bevel on the gear 142 corresponding to the angulation of the gear teeth 118. The bevelled gear 142 is mounted on a powered shaft 144 oriented centrally of the tubular shaft 46 and supported rotatably therefrom by bearing assemblies 146. The shaft 144 extends into a housing 148 on the power unit 16 and encloses a power source such as an internal combustion engine, electric motor or other power source by which the shaft 144 can be rotated thus rotatably driving the mixing drum 12 about the axis defined by the stationary shaft 120 rigidly affixed to the yoke 20. Preferably, the mixing drum is manually tiltable by manipulation of the hand wheel 62. The tilting operation can also be a power operated function if desired by connecting a hydraulic or pneumaticly operated ram to an offset arm connected to the shaft 58 in lieu of the hand wheel 62.

The interior of the mixing drum 12 includes a pair of paddle assemblies 150 oriented diametrically of each other and another pair of paddle assemblies 152 oriented diametrically of each other with the paddle assemblies 150 and 152 being alternately arranged as illustrated in FIG. 3. Each paddle assembly 150 preferably includes a generally rectangular, flat paddle 154 supported from the internal periphery of the mixing drum 12 by brackets 156 and 158 associated with the lower and upper ends of the paddle 154. The bracket 156 is attached to the inner wall of the channel shaped recess 90 above the lower end thereof and the upper bracket 158 is attached to the inner surface of the tapered portion 80 of the drum adjacent its juncture with the upper end of the channel shaped recess 90. As illustrated, the paddle 154 is generally radially disposed with respect to the rotational axis of the mixing drum but inclined longitudinally thereof with the lower of the paddle 154 leading the upper end thereof in the direction of rotation. As a result, the paddle tends to lift the cement mix upwardly as the mixing drum is rotated in a counterclockwise direction as observed in FIG. 3.

Preferably, each paddle assembly 152 includes a pair of generally parallel, radially spaced paddles including an outer paddle 160 and a longer inner paddle 161 both being supported by upper and lower brackets 162 attached to the interior of the cylindrical lower portion 78 of the mixing drum 12 and the interior of the tapered portion 80 of the mixing drum 12 as illustrated in FIGS. 3–5. The paddles 160 and 161 are longer than the paddles 154 and also extend radially inwardly and are angled in the same direction as the paddles 154 with the lower ends of the paddles 160 and 161 terminating closer to the bottom 84 of the drum to provide a lifting and mixing function to the concrete mix in the drum during rotational movement of the mixing drum.

The paddles 154 and paddles 160 and 161 are also constructed of high density polyethylene and the paddles 160 and 161 are unequal in length with the inner paddle 161 being longer than the outer paddle 160 in order for the lower ends to generally conform more closely to the configuration of trough 98 and the curvature of the bottom 84 of the mixing drum 12. The upper end of the radially inner paddles 161 also extend above the upper end of the shorter outer paddles 160.

FIG. 7 illustrates an alternative paddle assembly 150' in which the paddle 154' includes an inclined inner edge 155 which extends downwardly and inwardly for a major portion of its length and then inclines downwardly and outwardly at 155'. Also the lower end of the outer edge of the paddle 154' inclines downwardly and outwardly at 157 for generally conforming the contour of the paddle with the periphery of the bottom 84 and the upward projection 86 and the mixing drum 12. The inclination of the paddle 154' and the radial extent thereof and the mounting brackets are substantially the same as for the paddle 154.

In addition to the shield 54 for the gear 52, the gear 56 and associated locking plate 64 are provided with a shield 164 and the bevelled drive gear 142 is provided with a shield 166 on opposite sides thereof to shield the meshing engagement between the gear 142 and the teeth 118 on the ring gear 112.

The mixing drum 12 is subject to abrasive wear resulting from relative movement of the concrete mix in relation to the interior surface of the plastic drum. The wear on the interior of the drum is normally concentrated in the central area of the bottom 84 of the drum in view of the inward inclination of the upper tapered portion of the drum and paddle assemblies 150 and 152. The particular configuration of the projection 86 and the angle of the paddle assemblies and the construction of the paddles 154 and the paddles 160 and 161 reduces the wear on the bottom of the drum and increases the intermingling of the components of the concrete mix due to the alternate arrangement of the solid plate paddles 154 and the spaced paddles 160 and 161 in which the inner paddle 161 is longer and extends above and below the ends of the shorter paddle 160. Further, the rigid metal pan 100 provides a more effective support and reinforcement for the bottom area of the mixing drum than the use of upright cradle members which engage only a small portion of the longitudinal side wall of the drum at peripherally spaced points.

The pan 100 is preferably the bottom end of a conventional metal mixing drum that would be normally welded to a bottom edge of a metal mixing drum. Thus, the metal bottom pan is readily available to a manufacturer since it is generally the same as the bottom of a metal mixing drum with certain modifications incorporated therein, such as the provision of the bolts 106 which are welded to the interior of the short vertical flange 104. Another very important function of the metal pan, in addition to rigidifying and supporting the plastic mixing drum, is the fact that it will maintain the integrity of the mixing drum even in the event (albeit unlikely except after extensive use) that a hole is worn through the plastic bottom 84 of the mixing drum 12. As such, the mixer of this invention can be used until an on-site job has been completed even though a hole is worn in the bottom of the plastic drum, and the worn plastic drum replaced thereafter. In contrast, a mixer having a plastic drum supported by radial cradle arms such as disclosed in U.S. Pat. No. 5,118,198 would have to be immediately shut down inasmuch as a hole worn in the bottom of a plastic drum supported by radial cradle arms would result in an immediate leak of the concrete mix from the drum onto supporting surface areas thereby preventing completion of a job until a replacement mixer can be brought to the job site.

Similarly, the rigid ring gear 112 is preferably the same as that used in a metal mixer for the convenience and economy of manufacture. Further, in the formation of the plastic mixing drum 12, the cylindrical lower portion 78 of the drum is preferably molded to have a slight degree of tapered configuration. As the rigid ring gear 112 is bolted to the mixing drum 12, the fastening bolts 119 will cause the lower portion 78 of the drum to move into contact with the inner surface of the flange 114 of ring gear 112 thus causing the drum to become more circular in transverse configuration with the fastening arrangements being sufficient in number to not only make the lower portion of the drum more circular but also maintain it more circular as compared to a structure in which the upper ends of supporting cradle arms are connected to the ring gear and the plastic drum only at the upper end of the cradle arms. The location of the fastening members intermediate the rigidifying channel shaped recesses 90 thus maintain the cylindrical configuration of the drum even when loaded with concrete mix and during rotation of the drum when in a mixing position which may be generally a vertical position or an inclined angled position for more effective location of the paddle assemblies in relation to the concrete mix and the inner contour of the drum to reduce wear.

While the mixer 10, as illustrated, is preferably constructed as a side dumping mixer, it can readily be constructed as an end dumping mixer by rearranging the frame 14 and yoke 20 transversely of the path of movement of the mixer 10 when being towed rather than parallel to the path of movement. In addition, crosslinked polyethylene is presently the preferred material for molded drum 12. However, other plastic materials which have similar or better strength characteristics and also resist adhesion of the dried concrete mix thereon can be readily substituted.

Further, the foregoing is considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A concrete mixer comprising a supporting frame, yoke means mounted on said frame for pivotal movement about substantially a horizontal axis, a mixing drum constructed of plastic material, said drum having an opening in an upper end, a peripheral wall and a bottom, reinforcing means extending over a major portion of the radial and circumferential extent of an external surface area of said bottom, support means connected to said bottom reinforcing means to rotatably support the bottom of said drum from said yoke means for rotational movement of the drum about a generally centrally located longitudinal axis, and gear means connected to said drum for driving said drum rotationally about said longitudinal axis.

2. The concrete mixer as defined in claim 1 wherein said reinforcing means is a substantially rigid member conforming with and in continuous supporting engagement with said drum bottom throughout the circumferential extent of said drum bottom.

3. A concrete mixer comprising a supporting frame, yoke means mounted on said frame for pivotal movement about substantially a horizontal axis, a mixing drum constructed of plastic material, said drum having an opening in an upper end, a peripheral wall and a bottom, reinforcing means extending over a major portion of an external surface area of said bottom, support means connected to said bottom reinforcing means to rotatably support the bottom of said drum from said yoke means for rotational movement of the drum about a generally centrally located longitudinal axis, and gear means connected to said drum for driving said drum rotationally about said longitudinal axis and separated from and spaced vertically above said reinforcing means.

4. A concrete mixer comprising a supporting frame, yoke means mounted on said frame for pivotal movement about substantially a horizontal axis, a mixing drum constructed of plastic material, said drum having an opening in an upper end, a peripheral wall and a bottom, reinforcing means extending over a major portion of an external surface area of said bottom, support means connected to said bottom reinforcing means to rotatable support the bottom of said drum from said yoke means for rotational movement of the drum about a generally centrally located longitudinal axis, and gear means connected to said drum for driving said drum rotationally about said longitudinal axis, said reinforcing means being a rigid metal pan extending throughout the area of the plastic bottom of said drum and reinforcing the plastic bottom of the drum continuously radially and circumferentially in relation to the rotational axis.

5. The concrete mixer as defined in claim 4 wherein said support means rotatably supporting the drum from said yoke means includes a shaft and bearing means interconnecting said yoke means and said metal bottom pan for relative rotational movement of the bottom pan and drum in relation to the yoke means.

6. The concrete mixer as defined in claim 4 wherein said plastic bottom of the plastic drum is arcuately curved with a convex outer surface, said metal pan being correspondingly curved to conform with and engage the curved plastic bottom of the drum.

7. The concrete mixer as defined in claim 4 wherein said metal pan includes an upturned peripheral flange, said plastic drum including a plurality of longitudinally extending, inwardly offset recesses defining upwardly facing shoulders adjacent the bottom of the drum, fastening means on said pan connected with the upwardly facing shoulders on said drum thereby rigidly and detachably connecting the plastic mixing drum to the rigid metal pan to enable replacement of the drum, said metal pan being continuous across the bottom of said drum to enable continued use of the mixer even though a hole develops in the plastic bottom of the mixing drum.

8. The concrete mixer as defined in claim 4 wherein the plastic bottom of said drum includes a centrally disposed upwardly offset portion to receive said supporting means connected to said bottom reinforcing means.

9. A concrete mixer comprising a supporting frame, yoke means mounted on said frame for pivotal movement about substantially a horizontal axis, a mixing drum constructed of plastic material, said drum having an opening in an upper end, a peripheral wall and a bottom, reinforcing means extending over a major portion of an external surface area of said bottom, support means connected to said bottom reinforcing means to rotatably support the bottom of said drum from said yoke means for rotational movement of the drum about a generally centrally located longitudinal axis, and gear means connected to said drum for driving said drum rotationally about said longitudinal axis, and two pairs of alternately arranged paddle assemblies mounted interiorly of said drum with the paddles in each pair being diametrically opposed, each of one pair of paddle assemblies including a one piece, inclined paddle, each of the other pair of paddle assemblies including a pair of radially spaced inclined paddles, said paddles in the other pair of paddle assemblies having a length greater than the one-piece paddles to provide a lifting force to concrete mix in the drum.

10. The concrete mixer as defined in claim 9 wherein said reinforcing means is a rigid metal pan extending throughout the area of the plastic bottom of said drum and reinforcing the plastic bottom of the drum continuously radially and circumferentially in relation to the rotational axis.

11. The concrete mixer as defined in claim 10 wherein said means rotatably supporting the drum from said yoke means includes a shaft and bearing means interconnecting said yoke means and said metal bottom pan for relative rotational movement of the bottom pan and drum in relation to the yoke means.

12. The concrete mixer as defined in claim 11 wherein said plastic bottom of the plastic drum is arcuately curved with a convex outer surface, said metal pan being correspondingly curved to conform with and engage the curved plastic bottom of the drum.

13. The concrete mixer as defined in claim 12 wherein said metal pan includes an upturned peripheral flange, said plastic drum including a plurality of longitudinally extending, inwardly offset recesses defining upwardly facing shoulders adjacent the bottom of the drum, fastening means on said pan connected with the upwardly facing shoulders on said drum thereby rigidly and detachably connecting the plastic mixing drum to the rigid metal pan to enable replacement of the drum, said metal pan being continuous across the bottom of said drum to enable continued use of the mixer even though a hole develops in the plastic bottom of the mixing drum.

14. A concrete mixer comprising a supporting frame, yoke means mounted on said frame for pivotal movement about substantially a horizontal axis, a mixing drum constructed of plastic material, said drum having an opening in an upper end, a peripheral wall and a bottom, reinforcing means extending over a major portion of an external surface area of said bottom, support means connected to said bottom reinforcing means to rotatably support the bottom of said drum from said yoke means for rotational movement of the drum about a generally centrally located longitudinal axis, and gear means connected to said drum for driving said drum rotationally about said longitudinal axis, said frame including a pair of aligned bearing sleeves, said yoke means comprising a generally horizontal member and upwardly extending members having an upper end, a supporting shaft at the upper end of said upwardly extending members of said yoke means rotatably journaled in said bearing sleeves for pivotal movement of said yoke means about an axis defined by said bearing sleeves.

15. The concrete mixer as defined in claim 14 wherein said means for driving said drum includes a ring gear encircling the peripheral wall of said drum, means connecting said ring gear to said drum at a plurality of circumferentially spaced points.

16. The concrete mixer as defined in claim 15 wherein said ring gear is of rigid metal construction having a vertical inner flange, said means securing the drum to the ring gear including fastening members interconnecting the vertical flange of the ring gear with the peripheral wall of the drum for retaining the peripheral wall of the drum in contact with the vertical flange on the ring gear.

17. The concrete mixer as defined in claim 16 wherein said mixing drum includes a plurality of circumferentally spaced, longitudinally extending recesses formed in the side wall of the drum with the fastening members connecting the vertical flange of the ring gear and the peripheral wall of the drum being located between adjacent recesses.

18. The concrete mixer as defined in claim 17 wherein said reinforcing means for the plastic bottom of the drum includes a rigid metal pan conforming with and engaging the bottom of the drum to support and rigidify the bottom of the drum and enabling continued use of the drum when a hole is formed in the plastic bottom of the drum due to abrasion due to movement of a concrete mix within the mixing drum when the drum is being rotated.

19. The concrete mixer as defined in claim 18 wherein said metal pan includes upwardly extending, peripherally arranged fastening bolts, each of said recesses including a laterally extending, upwardly facing shoulder provided with a radially inwardly extending notch, said notches receiving said bolts therein and retaining nuts on said bolts exerting a clamping force on the upwardly facing shoulders for removably securing said drum to said pan in a manner to enable easy assembly and disassembly of the drum and pan to facilitate replacement of the drum.

20. The concrete mixer as defined in claim 19 wherein said drum includes paddle assemblies mounted interiorly of the drum, said paddle assemblies including at least one radially extending, longitudinally extending plate, said plate being inclined with a lower edge thereof in advance of a top edge thereof in the direction of rotation of said drum for lifting and mixing a concrete mix in the drum, said paddle assemblies also including at least one pair of longitudinally extending and radially spaced paddles, said radially spaced paddles having a lower edge in advance of an upper edge in the direction of rotation of the drum for lifting and mixing a concrete mix during rotation of the drum.

21. The concrete mixer as defined in claim 20 wherein said frame and drum includes rotatable means engaging said yoke means to pivot the yoke means to move the drum between an upwardly opening mixing position to a position with the opening oriented to discharge mixed concrete from the opening in the drum and means locking said yoke means from pivotal movement when the drum is in mixing position.

22. A mixer comprising a mixing drum constructed of plastic material, said drum having an opening in an upper end, a peripheral wall and a bottom support means connected to said drum for rotational movement of the drum about a generally centrally located longitudinal axis, means connected to said drum for driving said drum rotationally about said longitudinal axis, and two pairs of alternately arranged paddle assemblies mounted interiorly of said drum with the paddles in each pair being diametrically opposed, each of one pair of paddle assemblies including a one piece, inclined paddle, each of the other pair of paddle assemblies including a pair of radially spaced inclined paddles, said paddles in the other pair of paddle assemblies having a length greater than the one-piece paddles to provide a lifting force to concrete mix in the drum.

23. A concrete mixer comprising a mixing drum constructed of plastic material, said drum having an opening in an upper end, a peripheral wall and a bottom, reinforcing means extending over a major portion of an external surface area of said bottom, support means connected to said drum to rotatably support the drum for rotational movement of the drum about a generally centrally located longitudinal axis, and gear means connected to said drum for driving said drum rotationally about said longitudinal axis, said gear means being separated from and spaced vertically above said bottom reinforcing means.

24. The concrete mixer as defined in claim 23 wherein said reinforcing means is a rigid metal pan extending throughout the area of the plastic bottom of said drum and reinforcing the plastic bottom of the drum continuously radially and circumferentially in relation to the rotational axis.

25. The concrete mixer as defined in claim 24 wherein said gear means for driving said drum includes a ring gear encircling the peripheral wall of said drum, means connecting said ring gear to said drum at a plurality of circumferentially spaced points.

26. The concrete mixer as defined in claim 25 wherein said ring gear is of rigid metal construction having a circular vertical inner flange, said means securing the drum to the ring gear including fastening members interconnecting the vertical flange of the ring gear with the peripheral wall of the drum for retaining the peripheral wall of the drum in conforming contact with the vertical flange on the ring gear.

* * * * *